United States Patent [19]

Kelly

[11] 4,389,826

[45] Jun. 28, 1983

[54] PLATE BONDED SYSTEM ON TOP OF RUBBER AND METHOD OF PREPARING SAME

[76] Inventor: Thomas L. Kelly, 50 Randolph Ave., Waterbury, Conn. 06710

[21] Appl. No.: 183,343

[22] Filed: Sep. 2, 1980

[51] Int. Cl.[3] ..... E04B 5/00

[52] U.S. Cl. ..... 52/410; 52/741

[58] Field of Search ..... 52/506, 512, 408, 409, 52/410, 741

[56] References Cited

U.S. PATENT DOCUMENTS

| | | | |
|---|---|---|---|
| 3,377,760 | 4/1968 | Waite | 52/410 |
| 4,074,501 | 2/1978 | Sandqvist | 52/410 X |
| 4,162,597 | 7/1979 | Kelly | 52/410 |

FOREIGN PATENT DOCUMENTS

| | | | |
|---|---|---|---|
| 1956926 | 5/1971 | Fed. Rep. of Germany | 52/409 |
| 2300798 | 7/1974 | Fed. Rep. of Germany | 52/410 |
| 2812450 | 9/1979 | Fed. Rep. of Germany | 52/410 |
| WO80/01491 | 7/1980 | PCT Int'l Appl. | 52/512 |

*Primary Examiner*—Carl D. Friedman

*Attorney, Agent, or Firm*—Hayes & Reinsmith

[57] ABSTRACT

A roofing installation comprising a plurality of basic supporting elements for blocks of insulation upon which is disposed a composite board. A plurality of spot bonding pads and the composite board are covered respectively with a flexible membrane cover and with a roofing membrane which is flexible and preferably formed of rubber. The cover extends over each spot bonding pad and is adhesively secured thereto, the cover extending beyond the edges of the spot bonding pad and such extensions of the cover are adhesively secured to the flexible membrane. Each spot bonding pad is adhesively secured to the flexible membrane. A screw extends through the cover, the spot bonding pad, the membrane, the composite board, the insulation and the remaining roofing elements. Means covering the head of the screw is adhesively secured thereto and to the aforesaid cover and, in this form of the invention, the cover is not adhesively secured to the spot bonding pad and the spot bonding pad is not adhesively secured to the flexible membrane. An additional form of the invention encloses the head of the screw by the cover which is adhesively secured to the flexible membrane as well as the head of the screw, the spot bonding pad and the flexible membrane.

12 Claims, 5 Drawing Figures

PLATE BONDED SYSTEM ON TOP OF RUBBER AND METHOD OF PREPARING SAME

BRIEF SUMMARY OF THE INVENTION

This invention relates to a novel roofing structure which includes a plurality of blocks of any suitable type of insulation and preferably a composite relatively thin board positioned on top of the blocks of insulation. Disposed upon and covering this composite board is a flexible membrane which is preferably, though not necessarily, formed of rubber and provides the top surface for the roofing structure. It is essential that this flexible membrane be caused to soundly and firmly adhere to the composite board so that it will not become separated therefrom under the action of winds or because of any other disruptive influence. A plurality of spaced apart spot bonding pads are utilized which are preferably, though not necessarily, composed of Masonite fiberboard and such bonding pads are compatible with many types of adhesive. It has been my experience that flexible membranes of this particular character will be mounted and maintained in proper position on top of the roofing structure, if at each bonding pad a flexible cover is provided which is adhesively secured to the bonding pad, and if such cover is dimensionally greater than the bonding pad with which it is adhesively associated, and if the areas of the cover which extend beyond the perimeter of the bonding pad extend over and are adhesively secured to the flexible membrane. The entire assembly, including the blocks of insulation, are anchored to the basic roof structure, in a manner as will be explained.

In one form of the invention the flexible cover extends over not only the spot bonding pad but also over the head of the fastening means or screw which extends through the assembly and the metal deck to maintain the assembly in position. In installations where the screw head is exterior of the cover an overpatch may be employed to protect the screw head from the elements or any other factors which might cause deterioration thereof. Such overpatch is adhesively secured to the screw head as well as to the cover. It is also within my contemplation to eliminate the adhesive means between the cover and the spot bonding pad as well as between the spot bonding pad and the flexible membrane and in this instance it will be clear, as this description proceeds that the extending portions of the cover which are adhesively secured to the flexible membrane function to maintain the flexible membrane in proper roof covering position.

Additional objects and advantages of the present invention will become more readily apparent to those skilled in the art when the following general statements and descriptions are read in the light of the appended drawings.

DETAILED DESCRIPTION

Figure 3:
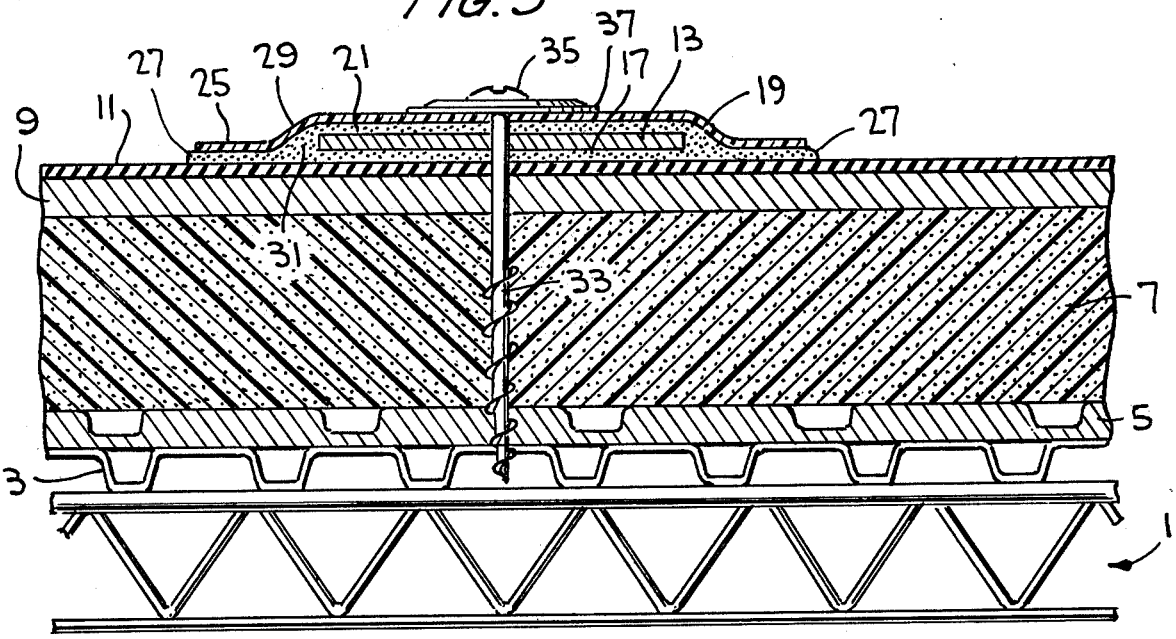
FIG. 3 is a sectional view illustrating the entire roofing structure.

In the accompanying drawings and particularly in FIG. 3 thereof a roofing installation is disclosed which involves a plurality of steel joists which are designated in their entirety by the numeral 1. Mounted on the steel joists is a metal decking 3, and a reservoir board 5 is mounted on the metal decking 1. The reservoir board 5 may be of the type illustrated in my pending patent application Ser. No. 160,948 filed June 19, 1980. A plurality of blocks of insulation 7 are mounted on the reservoir board 5 and these blocks may be formed of any suitable and desirable insulating medium. A composite board 9 is laid on the blocks of insulation 7 and fully covers such blocks. A flexible roofing membrane 11 is applied to and mounted on the composite board 9 and provides the upper covering for the roofing structure, as will become evident as this description proceeds.

Figure 1:
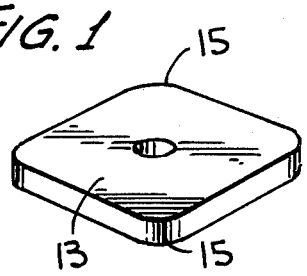
FIG. 1 is a view in perspective of a spot bonding pad.
Figure 2:
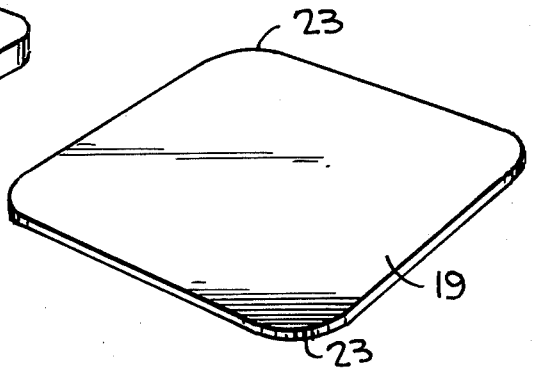
FIG. 2 is a perspective view of the cover.

The following assembly which will be described in detail provides the means by which the flexible membrane 11 is soundly and firmly caused to maintain its covering position over the composite board 9 and provides an assembly which may be incorporated in the roofing structure with relative facility by the roofing installers. A plurality of spaced apart bonding pads 13 are provided and such bonding pads are preferably, though not necessarily, composed of Masonite fiberboard or any material which is compatible with an adhesive. Each bonding pad 13 is provided with curved corners 15, as particularly illustrated in FIG. 1 of the drawings. Such rounded corners will prevent tearing or other mutilation of any of the elements of the assembly in the event of their disruption or destruction under extreme conditions which might possibly occur. Each bonding pad 13 extends over the flexible membrane 11 and is firmly secured thereto by means of an adhesive 17 which may comprise a butyl gum. A cover element 19 is provided and this cover element is flexible and dimensionally greater than the dimension of the spot bonding pad 13 which it overlays. The flexible cover element 19 is preferably, though not necessarily, formed of the same material as in the flexible membrane 11. The cover member 19 is applied over the spot bonding pad 13 and is adhesively caused to adhere thereto by means of the adhesive 21. Such adhesive functioning to securely fasten a portion of the cover member 19 to the spot bonding pad 13. As is apparent from consideration of FIG. 2 of the drawings the cover member 19 is provided with rounded corners 23 which function in the manner of rounded corners 15 of the spot bonding pad 13. The flange or extended portions 25 of the flexible cover element 19 extend beyond the perimeter of the spot bonding pad 13 so that such extensions 25 extend over the flexible membrane 11, and such extensions are adhesively secured to the membrane by means of adhesive 27. It is to be noted that the extensions 25 are bent to incline downwardly toward the flexible membrane 11 and the downwardly bent portion 29 of such extensions is also adhesively secured to the flexible membrane 11 by the adhesive 31. The assembly including the cover 19, the spot bonding pad 13 and the adhesive layers are securely fastened to the roofing structure by means of a screw 33 having a head 35 and a washer 37, and such screw extends through cover 19, the pad 13, the composite board 9, the insulation blocks 7, the reservoir board 5 and into and through the metal decking 3 so that this entire assembly is securely fastened to the basic elements of the roof. It will now be appreciated that in a roofing installation following the concepts of this invention where spaced apart spot bonding pads are employed and these spot bonding pads are positioned over the flexible membrane and are cemented thereto by any suitable type of adhesive. A flexible cover element of greater dimensions than the spot bonding pad extends thereover, is adhesively secured thereto and the extending portions thereof are adhesively secured to the flexible membrane. The assembly just described is fastened to the roof deck by a screw or other suitable fastening means. Thus, the flexible sheet membrane is adhesively connected to the roof by means of the cover extensions, the spot bonding pads and the fastening means.

Figure 4:
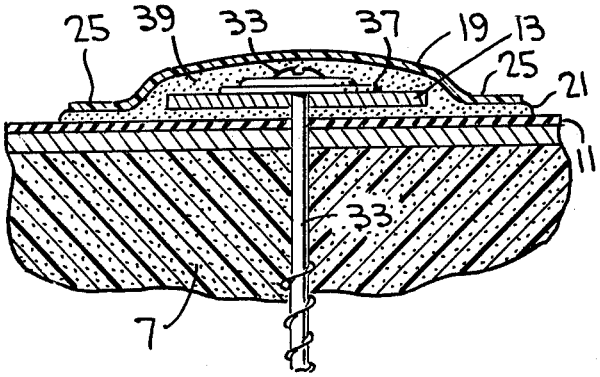
FIG. 4 is a detailed sectional view illustrating a further form of the invention.

In FIG. 4 of the drawings a modification of the assembly is illustrated and in this figure I shall use the same reference numerals for similar parts as heretofore used. In this form of the invention the cover 19 instead of being disposed below the screwhead 35 and the washer 37 is disposed on and over these elements and is adhesively secured to the screwhead 35 and washer 37 and also to the spot bonding pad 13 by means of adhesive 39. In this form of the invention, as in the form heretofore discussed the extensions 25 of the cover 19 extend over and are adhesively secured to the membrane 11 by means of adhesive 21. By disposing the cover 19 in the manner just described it will be clear that the screwhead and washer will not have imparted thereto the deteriorating effects of the weather and the like.

Figure 5:
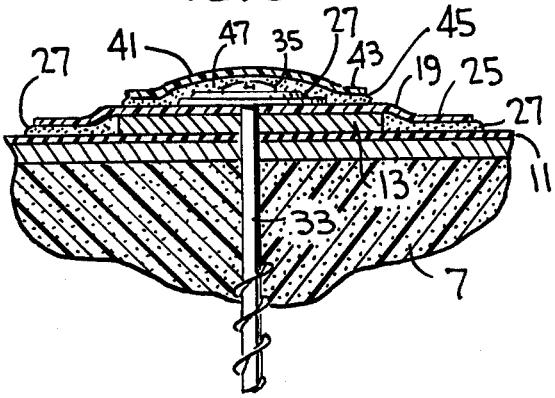
FIG. 5 is a detailed sectional view illustrating a further form of the invention and particularly illustrating the utilization of an overpatch.

FIG. 5 illustrates a further form which the invention may take, and again in this form, I have used the reference numerals for similar parts as heretofore used. In this form of the invention, the screwhead 35 and washer 37 are positioned above the flexible cover 19 having the extensions 25. However, the extensions 25 of cover 19 which extend over the bonding pad 13 are caused to adhere to the membrane 11 by means of the adhesive 27. In order to cover the screwhead 35 and washer 37, a flexible overpatch 41 is provided which is dimensionally greater than the dimensions of the washer 37 thereby providing extensions 43 which are adhesively secured to the cover 19 by means of an adhesive 45 and the overpatch 41 is also secured to the screwhead 35 and the washer 37 by means of an adhesive 47.

When a roof of this character is being installed in the field and with the flexible sheet membrane 11 having been laid over the composite board 9 the roof installer positions a spot bonding pad 13 on top of the flexible sheet membrane to which has been applied the adhesive 17 so that the spot bonding pad is adhesively secured to the flexible sheet membrane. The cover element 19 is then laid in position over the spot bonding pad 13 and is adhesively secured thereto. The extensions 25 of the cover member are adhesively secured by the adhesive 27 to the flexible sheet membrane 11. Whereupon the screw 33 is screwed into operative position as particularly disclosed in FIG. 3 of the drawings. In this situation where the screwhead 35 and washer 37 are in exterior or in exposed position the overpatch 41 may be placed thereover and adhesively secured thereto as well as to the cover 19.

It is also within my contemplation to preassemble the pad and cover and in this preassembled form of the invention this may be done with or without the washer 37 and it is to be recognized that this preassembled unit is provided with the adhesive 21 securing the cover 19 to the spot bonding pad 13 and to the screwhead 35.

This preassembled unit is supplied to the workers in the field who would manually, or in any other suitable manner, apply the adhesive 27 skirt or extensions 25 would be firmly attached to the flexible membrane 11. When this preassembled unit is properly positioned on the roof in spaced relation to other similar units, the screw 33 is screwed through the elements of the preassembled unit, the composite board 9, the reservoir board 5 and the metal deck 3. Whereupon the overpatch 41 is applied to the screwhead 35 and adhesively secured thereto and to the cover 19.

What is claimed is:

1. A roofing installation including, in combination, a deck for supporting the roofing installation, insulation supported by the deck, a flexible membrane supported by the insulation, and a spot bonding pad compatible with adhesive and mounted on and adhesively secured to said flexible membrane, a flexible cover extending over said spot bonding pad and extending beyond the periphery thereof, the flexible cover being adhesively secured to said spot bonding pad and those portions of the cover which extend beyond the periphery of the spot bonding pad being adhesively secured to the flexible membrane, and a fastening means extending through said cover, the spot bonding pad, the flexible membrane, the insulation and the deck.

2. A roofing installation in accordance with claim 1, wherein a composite board is mounted on said insulation and said flexible membrane is mounted on said composite board, the fastening means extending through said cover, the spot bonding pad, the flexible membrane, the composite board, the insulation and the deck.

3. A roofing installation in accordance with claim 1, wherein said fastening means includes a head in fixed relation with the upper surface of said cover and an overpatch of greater dimensions than said head disposed thereover and adhesively secured thereto, the extending portions of said overpatch being adhesively secured to said cover.

4. A roofing installation in accordance with claim 1, wherein a reservoir board is mounted on said deck and said insulation is mounted thereon, and the fastening means extends through said cover, the spot bonding pad, the flexible membrane, the insulation, the reservoir board and the deck.

5. A roofing installation including, in combination, a supporting deck means, insulation mounted thereon, a flexible membrane supported by said insulation, and a spot bonding pad compatible with adhesive mounted on and adhesively secured to said flexible membrane, fastening means extending through said spot bonding pad, the flexible membrane, the insulation and the supporting deck means, and a cover extending over said fastening means and said spot bonding pad and being dimensionally greater than the dimensions of the spot bonding pad providing portions extending beyond the periphery of the spot bonding pad, said cover being adhesively secured to the spot bonding pad and those portions of the cover extending beyond the periphery of the spot bonding pad being adhesively attached to the flexible membrane.

6. A roofing installation in accordance with either claim 1 or claim 5, wherein said spot bonding pad and said cover have rounded corners.

7. A roofing installation in accordance with claim 5, wherein said fastening means includes a head in fixed relation with said cover, and an overpatch disposed over and covering said head and adhesively secured thereto, said overpatch being of greater dimensions than said head and the extending portions of said overpatch being adhesively secured to said cover.

8. A roofing installation comprising a supporting deck means, said supporting deck means supporting and covered by insulation, sheets of flexible membrane supported by and overlying said insulation, and a plurality of spaced apart spot bonding pads, said plurality of spaced bonding pads mounted on the flexible membrane, a flexible cover extending over each spot bonding pad and being dimensionally greater than the dimensions of the spot bonding pad providing extending portions beyond the periphery of the spot bonding pad, said extending portions of the flexible cover being adhesively secured to said flexible membrane, and fastening means extending through each bonding pad, the flexible membrane, the insulation and the supporting deck means.

9. A roofing installation in accordance with claim 8, wherein the fastening means additionally extends through the flexible cover.

10. A roofing installation including, in combination, a deck, roofing insulation supported by the deck, a flexible membrane supported by the insulation, and a spot bonding pad mounted on said flexible membrane, a flexible cover extending over said spot bonding pad and extending beyond the periphery thereof, those portions of the cover which extend beyond the periphery of the spot bonding pad being adhesively secured to the flexible membrane, and a fastening means extending through said cover, the spot bonding pad, the flexible membrane, the insulation and the deck.

11. A roofing installation in accordance with either claim 10 or claim 9, wherein the fastening means has a head and washer, the washer being secured by the fastening means head in engagement with said flexible cover, and a flexible overpatch of greater dimensions than said head and washer and adhesively secured thereto, the portions of said overpatch extending beyond the periphery of the head and washer being adhesively secured to the cover.

12. A method of associating a preassembled unit with a roofing installation, said unit comprising a spot bonding pad and a cover adhesively secured thereto, said cover being of greater dimensions than the dimensions of said spot bonding pad providing extensions of the cover which extend beyond the periphery of the spot bonding pad, said roofing installation comprising a flexible membrane and insulation and said flexible membrane being supported thereby, and the insulation being supported by a deck, comprising those steps of positioning said preassembled unit on the flexible membrane and adhesively securing said spot bonding pad to said flexible membrane, adhesively securing said extending portions to said flexible membrane, inserting fastening means through said cover, spot bonding pad, flexible membrane, insulation and the deck and covering each inserting fastening means.

* * * * *

UNITED STATES PATENT AND TRADEMARK OFFICE

CERTIFICATE OF CORRECTION

PATENT NO. : 4,389,826

DATED : June 28, 1983

INVENTOR(S) : Thomas L. Kelly

It is certified that error appears in the above—identified patent and that said Letters Patent is hereby corrected as shown below:

Column 4, line 6, wherein "27 skirt" should be --27 so that the skirt--.

Signed and Sealed this

*Twenty-second* Day of *November 1983*

[SEAL]

*Attest:*

GERALD J. MOSSINGHOFF

*Attesting Officer*

*Commissioner of Patents and Trademarks*